US005855510A

United States Patent [19]

McKenzie

[11] Patent Number: 5,855,510

[45] Date of Patent: Jan. 5, 1999

[54] SYSTEM FOR EXHAUSTING SMOKE AND CONTROLLING FIRES WITHIN A BUILDING

[76] Inventor: James McKenzie, 3150 Canary Ct., York, Pa. 17404-5717

[21] Appl. No.: 909,804

[22] Filed: Aug. 12, 1997

[51] Int. Cl.[6] ..... F24F 11/00

[52] U.S. Cl. ..... 454/342; 454/239; 454/16

[58] Field of Search ..... 454/16, 239, 252, 454/342, 345, 347, 350, 354, 357

[56] References Cited

U.S. PATENT DOCUMENTS

| | | | |
|---|---|---|---|
| 863,059 | 8/1907 | Elmer . | |
| 1,245,851 | 11/1917 | Wright . | |
| 1,874,573 | 8/1932 | Moore . | |
| 4,485,730 | 12/1984 | Baus . | |
| 4,765,231 | 8/1988 | Aniello | 454/239 |
| 4,805,835 | 2/1989 | Schaus . | |
| 4,928,583 | 5/1990 | Taylor et al. | 454/342 X |
| 4,944,216 | 7/1990 | McCutchen | 454/342 |

FOREIGN PATENT DOCUMENTS

| | | | |
|---|---|---|---|
| 2510643 | 7/1981 | France . | |
| 1465681 | 3/1989 | U.S.S.R. | 454/342 |

*Primary Examiner*—Harold Joyce

*Attorney, Agent, or Firm*—Caesar, Rivise, Bernstein, Cohen & Pokotilow, Ltd.

[57] ABSTRACT

A system for exhausting smoke from a building. The building has a roof, exterior walls and at least one room therein where smoke has accumulated. The system comprises an actuable compressor arranged to draw smokeless air from the atmosphere outside the building and force the atmospheric air through a conduit that is in communication with the compressor. The conduit permits the passage of the forced air therethrough and has a length extending across the room adjacent the ceiling of the room. The conduit has an exit end that is open to the atmosphere. The exit end projects through and extends some distance beyond the overhanging roof of the building to prevent reentry of exhausted smoke and gases. A smoke exhaust valve is located on the length of the conduit extending across the room. The smoke exhaust valve is normally in a closed position. A smoke detection means is provided for opening the smoke exhaust valve and for actuating the actuable compressor in response to detecting an amount of smoke in the room that exceeds a predetermined level. Whenever such an amount of smoke is detected, the smoke detection means actuates the actuable compressor which forces air through the conduit means. Smoke is drawn from the room into the conduit through the open smoke exhaust valve. The system vents the smoke to the atmosphere outside.

25 Claims, 5 Drawing Sheets

SYSTEM FOR EXHAUSTING SMOKE AND CONTROLLING FIRES WITHIN A BUILDING

BACKGROUND OF THE INVENTION

This invention relates generally to the field of systems for protecting from fires and smoke. More specifically, this invention relates to a system for exhausting smoke and controlling fires within a static structure, e.g. a building.

There have been some suggestions in the prior art for providing systems for controlling smoke and/or fires and exhausting smoke and gases from buildings. A representative apparatus for controlling smoke and fire in buildings is disclosed in U.S. Pat. No. 4,805,835 (Schaus). The device disclosed in that patent makes use of a smoke detector that is arranged to open a vent located within the residence upon detection of a predetermined concentration of smoke. The smoke detector also energizes an exhaust fan which draws smoke from the living spaces through the open vent and to the outside atmosphere.

An apparatus especially useful in combatting fires such as those in basements of stores is disclosed in U.S. Pat. No. 1,874,573 (Moore). The apparatus disclosed therein comprises a suction fan unit connectable to a foldable hood. The hood is placed over an opening in the sidewalk leading to the basement and creates an enclosed air passage between the fire and the suction fan. The fan draws smoke and gases out of the basement to be replaced with fresh air from other openings in the building which will facilitate the work of firemen. Although the apparatus may provide a means for exhausting smoke from a basement, it does not appear to do so in an automated manner. U.S. Pat. No. 863,059 (Elmer) and France Patent No. 2,510,643 (Worl) each disclose a vent for the escape of smoke combustion gases in burning buildings. These devices also do not appear to operate in an automated manner.

While the aforementioned patents seem suitable for their intended purposes, the above-mentioned drawbacks still appear to exist.

OBJECTS OF THE INVENTION

Accordingly, it is a general object of this invention to provide a system for exhausting smoke and gases from a static structure such as a building and controlling fires therein which overcomes the disadvantages of the prior art.

It is a further object of this invention to provide a system for exhausting smoke and gases and controlling fires within a building which is inexpensive to manufacture.

It is a further object of this invention to provide a system for exhausting smoke and gases and controlling fires within a building that is reliable in operation.

It is a further object of this invention to provide a system for exhausting smoke and gases and controlling fires within a building that is simple in construction.

It is a further object of this invention to provide a system for exhausting smoke and gases and controlling fires within a building that enables the escape of smoke and combustion gases during the fire.

It is a further object of this invention to provide a system for exhausting smoke and gases and controlling fires within a building that will improve access and visibility for fire fighting efforts.

It is a further object of this invention to provide a system for exhausting smoke and gases and controlling fires within a building that will reduce the amount of damage caused while extinguishing a fire.

It is a further object of this invention to provide a system for exhausting smoke and gases and controlling fires within a building that can be incorporated into existing buildings without the retrofitting of duct systems or can be installed as part of the construction of a new building.

It is a further object of this invention to provide a system for exhausting smoke and gases and controlling fires within a building that will minimize the extend of property damage.

It is a further object of this invention to provide a system for exhausting smoke and gases and controlling fires within a building that will prevent loss of life.

It is a further object of this invention to provide a system for exhausting smoke and gases and controlling fires within a building that will improve visibility and breathing conditions and will allow enough time for persons to evacuate the building without harm.

It is a further object of this invention to provide a system for exhausting smoke and gases and controlling fires within a building that alerts authorities including the police or fire department of the presence of fire.

It is a further object of this invention to provide a system for exhausting smoke and gases and controlling fires within a building that will impede the spread of fire therein.

It is a further object of this invention to provide a system for exhausting smoke and gases and controlling fires within a building that will contribute to reducing the cost of fire insurance.

It is a further object of this invention to provide a system for exhausting smoke and gases and controlling fires within a building that will increase the operating efficiency of fire control systems, e.g., sprinkler systems, within the building.

It is a further object of this invention to provide a system for exhausting smoke and gases and controlling fires within a building that is adapted for wide application, i.e., in residences as well as in commercial buildings.

It is a further object of this invention to provide a system for exhausting smoke and gases and controlling fires within a building wherein the system includes components that may be utilized in combination with ducts already existing in the building to provide conventional, heating, cooling and air conditioning functions.

SUMMARY OF THE INVENTION

These and other objects of this invention are achieved by providing a system for exhausting smoke from a building. The building has a roof, exterior walls and at least one room therein where smoke has accumulated. The system comprises an actuable compressor arranged to draw smokeless air from the atmosphere outside the building and force the atmospheric air through a conduit that is in communication with the compressor. The conduit permits the passage of the forced air therethrough and has a length extending across the room adjacent the ceiling of the room. The conduit has an exit end that is open to the atmosphere. The exit end projects through and extends some distance beyond the overhanging roof of the building to prevent reentry of exhausted smoke and gases. A smoke exhaust valve is located on the length of the conduit extending across the room. The smoke exhaust valve is normally in a closed position. A smoke detection means is provided for opening the smoke exhaust valve and for actuating the actuable compressor in response to detecting an amount of smoke in the room that exceeds a predetermined level. Whenever such an amount of smoke is detected, the smoke detection means actuates the actuable compressor which forces air through the conduit means.

Smoke is drawn from the room into the conduit through the open smoke exhaust valve. The system vents the smoke to the atmosphere outside.

DESCRIPTION OF THE DRAWINGS

Other objects and many attendant features of this invention will become readily appreciated as the same becomes better understood by reference to the following detailed description when considered in connection with the accompanying drawings wherein.

DETAILED DESCRIPTION OF THE PREFERRED EMBODIMENTS

Figure 1:
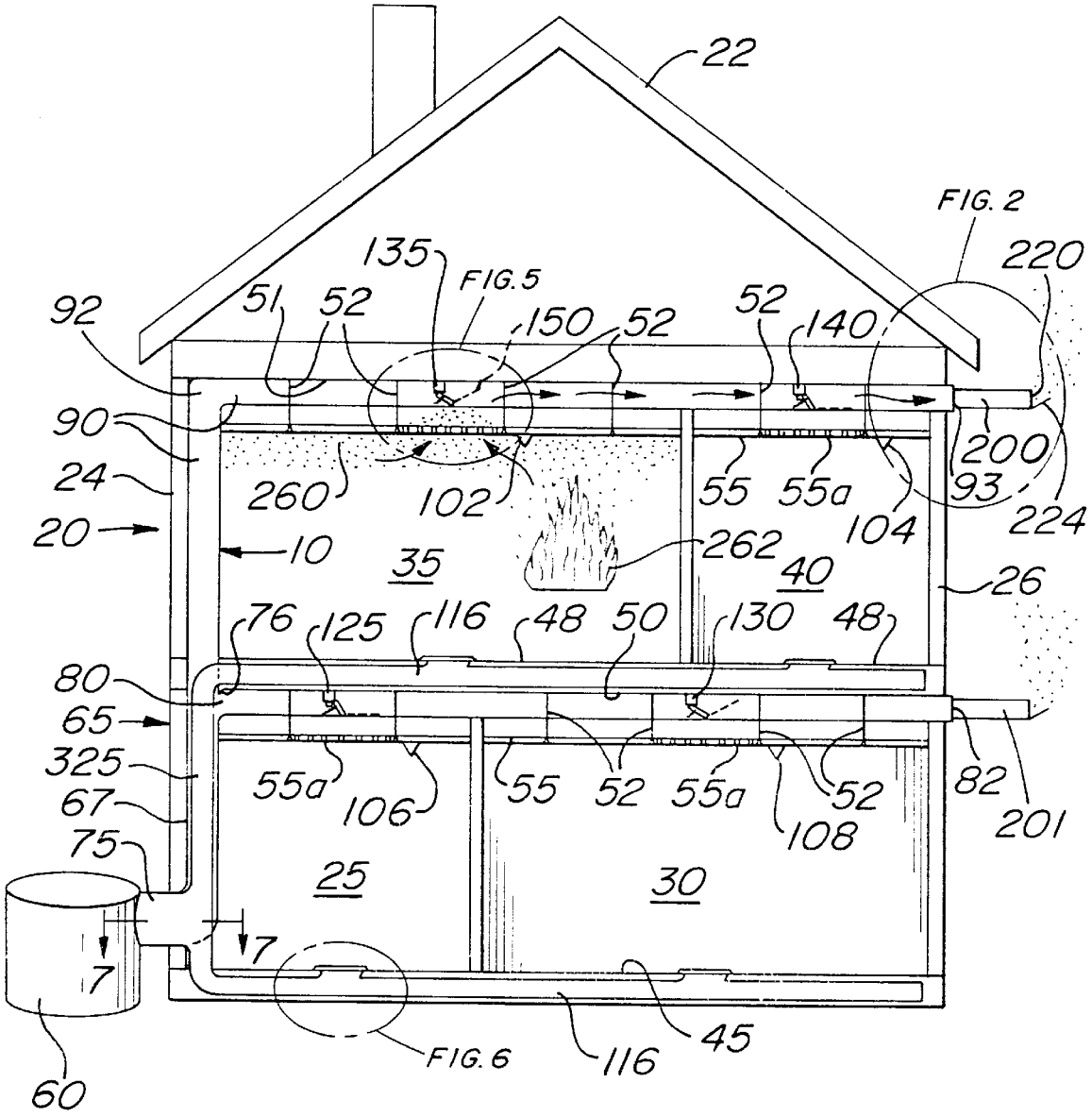
FIG. 1 is an diagrammatic elevation view of a building in which system of the present invention is installed.

Referring now in greater detail to the various figures of the drawings wherein like reference numerals refer to like parts there is shown at 10 in FIG. 1 an improved smoke exhaust system constructed in accordance with this invention. The details of the system 10 will be described later. Suffice it for now to say that the improved smoke exhaust system 10 of the present invention is arranged to be mounted within a building such as a residence as is shown at 20 in FIG. 1 and is provided for exhausting smoke and combustion gases that result from fire. It should be pointed out at this juncture that the specific type of building shown herein at 20 is merely an exemplary type of building for which the subject invention has utility. Moreover, it is to be understood that the system of the present invention can be utilized in any type of building to exhaust smoke therefrom. Therefore, the system of the present invention has a relatively broad field of application, ranging from small residences to large hotels, office buildings, warehouses, factories and other buildings.

The residence 20 is shown in FIG. 1 as having a pitched roof 22 that hangs over or extends beyond the exterior walls 24 and 26. The residence 20 comprises a two story structure with rooms on each story. Two of the rooms located on the lower story of the residence are shown at 25 and 30 as having a floor 45 and ceiling 50 while two of the rooms located on the upper story are shown at 35 and 40 as having a floor 48 and ceiling 51.

Figure 2:
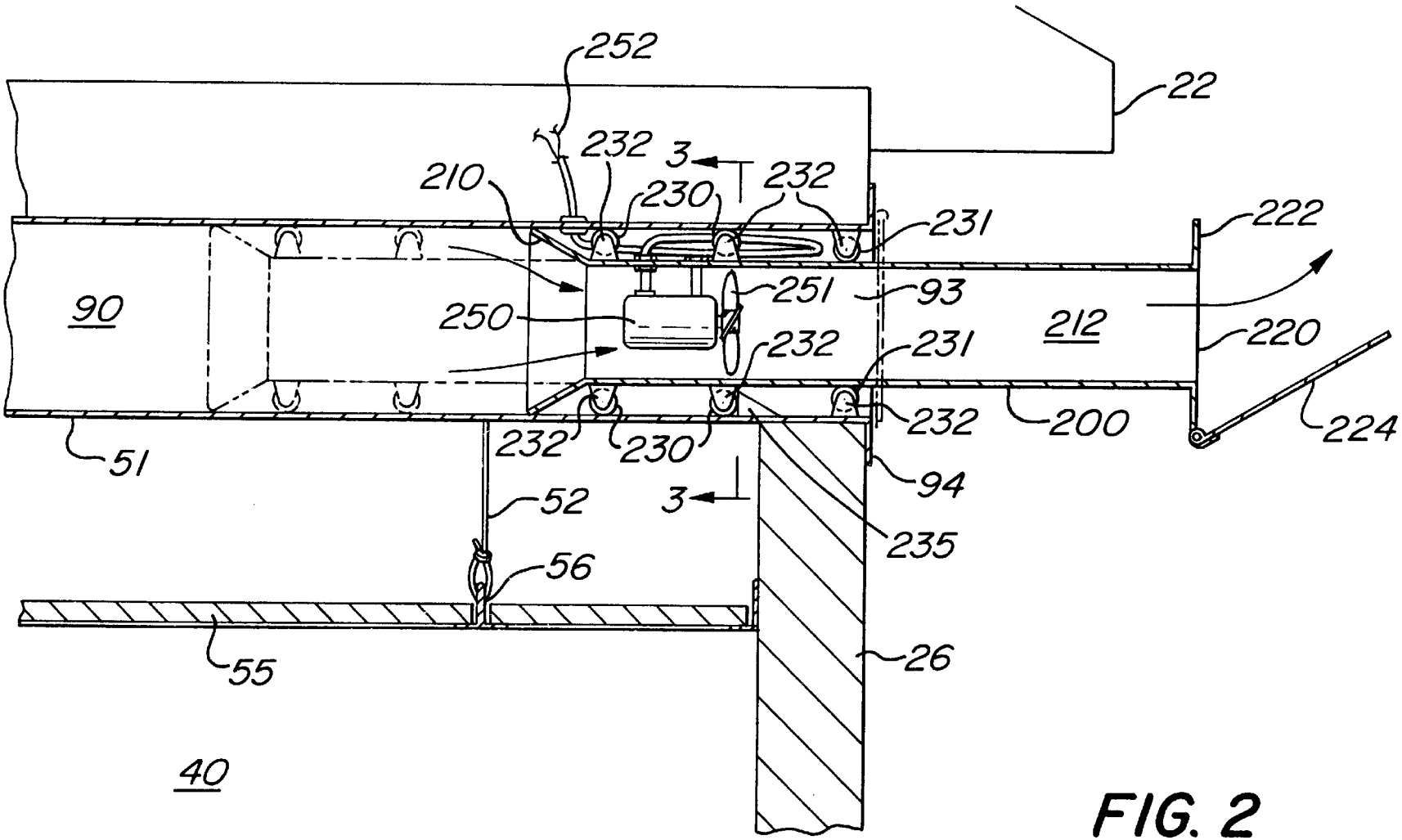
FIG. 2 is an enlargement of an area shown in FIG. 1 that is encircled by a line labelled FIG. 2.

Referring now to FIGS. 1 and 2, a false ceiling 55 is suspended within each room, 25, 30, 35 and 40, by means of a plurality of support wires 52 attached to the ceilings 50 and 51 and extending downwardly therefrom. The false ceiling 55 has a downwardly facing decorative surface that is exposed to view by occupants within the room. The support wires 52 suspend the false ceiling 55 by attachment, e.g., tying, to brackets 56 extending upwardly from the false ceiling 55. The false ceiling 55 provides a decorative effect to the home while hiding a portion of the system of the present invention from view. At this juncture, it is important to mention that the presence or absence of the false ceiling 55 is not critical to the operability of the smoke exhaust system 10 of the present invention. Rather, the false ceiling is shown in the figures to demonstrate that the smoke exhaust system 10 of the present invention may be effectively utilized in combination with a false ceiling 55 which hides the system 10 from view.

As best shown in FIG. 1, a compressor unit 60 is located external to and adjacent the residence 20. Where the system 10 of the present invention is being installed into an existing building, rather than being incorporated as part of new construction, the conventional compressor unit already being utilized at the building 20 for providing heating, ventilation and air conditioning in known ways may be utilized as the compressor unit 60 of the present invention.

By means of suitable conductors, the compressor 60 is in communication with a plurality of smoke detectors 102, 104, 106 and 108 located within each room of the house. In particular, a smoke detector 102 is shown attached to the decorative side of the false ceiling 55 within room 25. Likewise, smoke detectors 104, 106 and 108 are shown attached to the decorative side of the false ceiling 55 in rooms 30, 35 and 40, respectively. Whenever the compressor unit 60 is energized by an energizing current provided by any of the smoke detectors 102, 104, 106 or 108, the compressor unit 60 draws ambient air from the atmosphere, increases its pressure and forces the compressed air through a cylindrical vent duct 75 connected thereto.

Each smoke detector 102, 104, 106 and 108, shown in FIG. 1, is a well-known type to those having ordinary skill in the fire protection engineering art, such as a photoelectric type smoke detector or an ionization type smoke detector. Each contains a suitable battery (not shown) for operating the smoke detector. It is to be understood, however, that in alternative embodiments of my invention the smoke detectors will be operated by means of alternating current provided through power lines within the building. Further, in a manner that is known in the prior art, upon detection of smoke, each smoke detector is arranged to send a signal to proper authorities, e.g., police, fire department, central station, providing notification of the detection of smoke.

Figure 6:
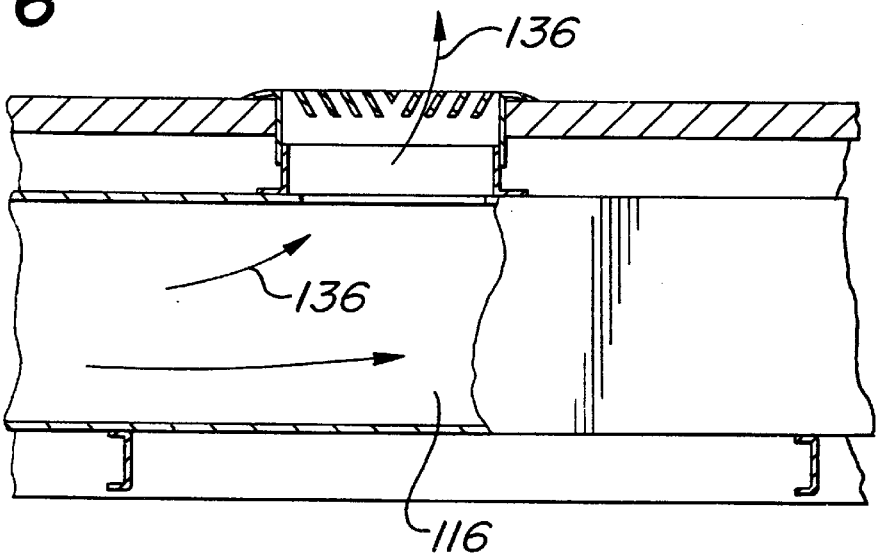
FIG. 6 is an enlargement of an area shown in FIG. 1 that is encircled by a line labelled FIG. 6; and, FIG. 7 is an enlarged sectional view taken along line 7—7 of FIG. 1.
Figure 7:
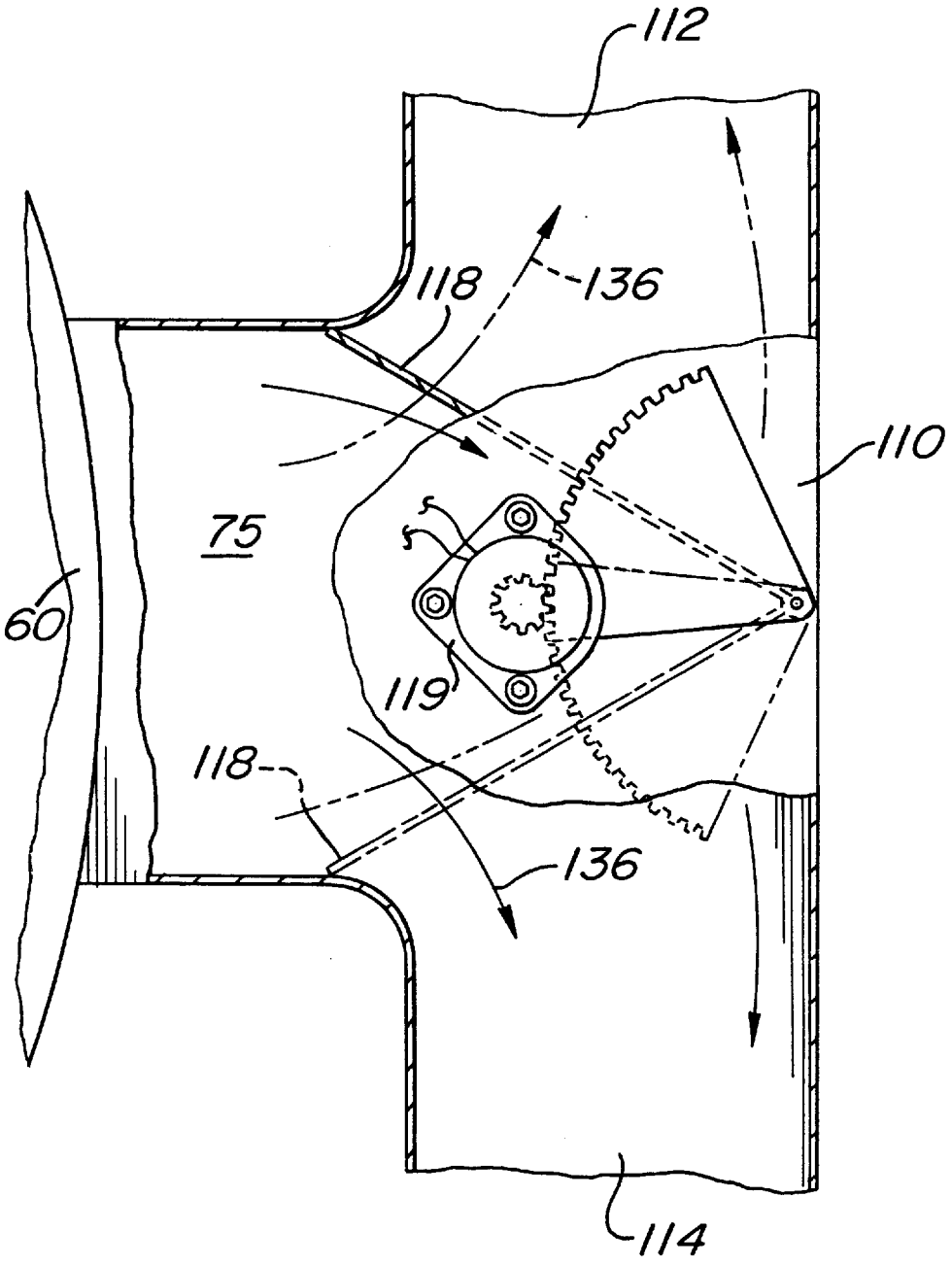

Referring now to FIGS. 1 and 7, the cylindrical vent duct 75 extends from the compressor unit 60 through the exterior wall 24 of the residence 20 and conveys the forced air, indicated by arrow 136, into a duct junction 110 where it can travel into either of two branches 112 and 114. Branch 114 leads the forced air 136 into a conventional duct system 116 for providing conventional heating, ventilation and air conditioning. The conventional duct system 116 may have been installed at the time the building was built. In the event the duct system 116 is not suitable for use in combination with the compressor 60, a suitable duct system may be installed at the time the system 10 of the present invention is installed. The duct system 116 runs below the floors 45 and 48 of the rooms 25, 30, 35 and 40 on the lower and upper stories. Referring now to FIG. 6, there is shown therein a portion of the duct system 116 existing within the room 25 in communication with an air register 120 through which the forced air 136 can escape into the room. Branch 112 leads the forced air 136 into a smoke exhaust conduit network 65 which forms a portion of the system 10 of the present invention.

Hingedly connected within the duct junction 110 is a vent door 118 that is arranged to swing from a normal position (shown in solid lines) to an open position (shown in phantom lines). Movement of the vent door 118 is controlled by a servo-motor 119 that is electrically connected to the smoke detectors 102, 104, 106 and 108, previously mentioned. The vent door 118 remains in the normal position until it receives an energizing current from any one of the smoke detectors. In the normal position, the vent door 118 enables passage into the conventional duct system 116 and blocks passage of the forced air 136 into the smoke exhaust conduit network 65. Upon receiving an energizing current from one of the smoke detectors, the servo-motor 119 causes the vent door 118 to swing from the normal position to the open position, thus enabling passage into the smoke exhaust conduit network 65 and blocking passage of the forced air 136 into the conventional duct system 116.

As best shown in FIGS. 1, the smoke exhaust conduit network 65 comprises a main duct 67 that extends upwardly from the cylindrical vent duct 75 to a junction point 76. At the junction point 76, the main duct 67 divides into a plurality of conduit branches 80 and 90. It should be understood that although FIG. 1 illustrates the smoke exhaust conduit network as comprising only two conduit branches, 80 and 90, this is merely an exemplary number of branches and a greater or fewer number of branches could be utilized based upon the size and configuration of the building in which the system 10 is being utilized without departing from the invention.

The conduit branch 80 extends horizontally from the main duct 67 at the junction point 76 through rooms 25 and 30 on the lower story in a narrow space between ceiling 50 and the false ceiling 55. In an alternative embodiment (not shown), the conduit branch 80 could extend horizontally above the ceiling 50 and rest upon joists (not shown) extending between the ceiling 50 and the floor 48 of the upper story. The conduit branch 80 extends through the exterior wall 26 of the residence 20 and has an open exit end 82 that is approximately flush with the exterior surface of the exterior wall 26. The conduit branch 80 is provided with a flange (not shown) that enables securement of the conduit branch 80 to the exterior surface of the wall 26.

Similarly, the conduit branch 90 extends upwardly from the main duct 67 at the junction point 76 to an elbow 92 located just below the ceiling 51. Thereafter, the conduit branch 90 extends horizontally through rooms 35 and 40 on the upper story in a space between the ceiling 51 and the false ceiling 55. In an alternative embodiment (not shown), the conduit branch 90 could extend horizontally above the ceiling 51 and rest upon joists (not shown) extending above the ceiling 51. Referring now to FIGS. 1 and 2, the conduit branch 90 extends through the exterior wall 26 and has an open exit end 93 that is approximately flush with the exterior surface of the wall 26. As best shown in FIG. 2, the conduit branch 90 is provided with a flange 94 that enables securement of the conduit branch 90 to the exterior surface of the exterior wall 26.

Figure 3:
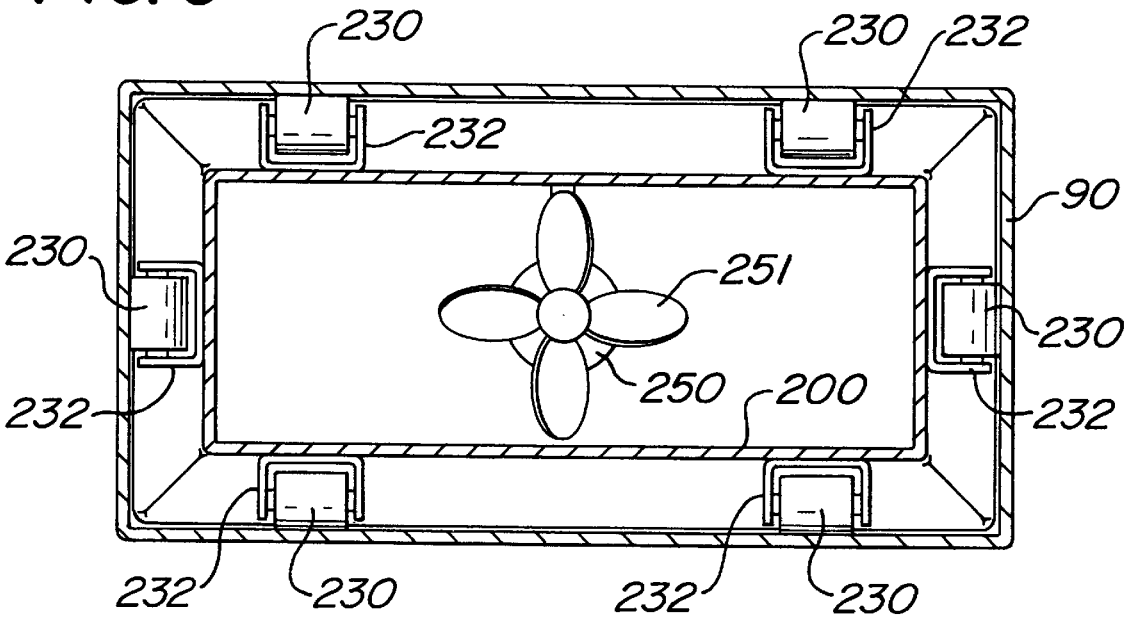
FIG. 3 is an enlarged sectional view taken along line 3—3 of FIG. 2.
Figure 4:
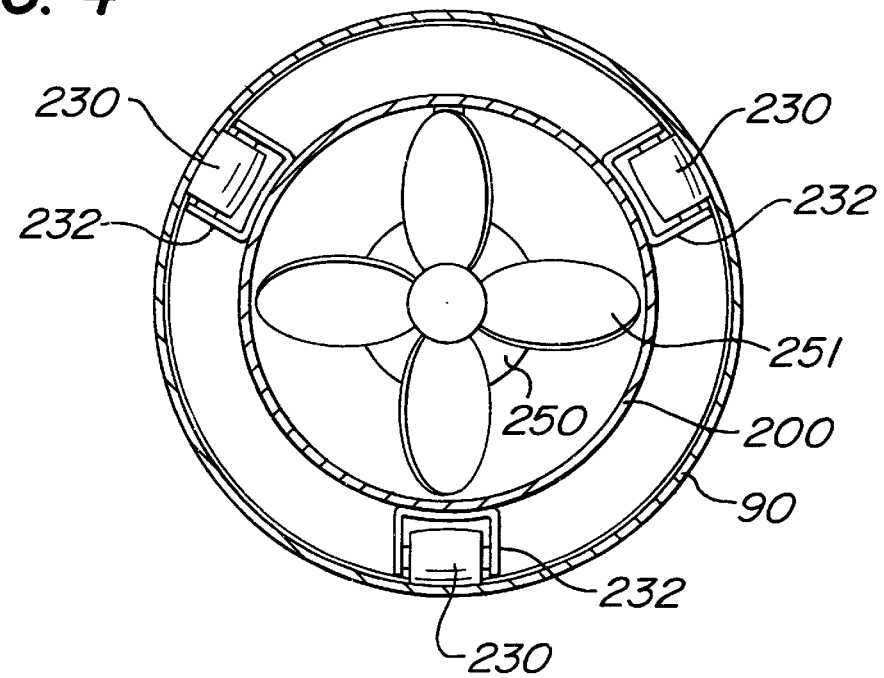
FIG. 4 shows an alternative embodiment of the conduit and extension segment components of the present invention.

The conduit branches 80 and 90 may be formed of any suitable material resistant to heat, e.g., aluminum, or any hard plastic, such as polyvinyl chloride (PVC). The conduit branches 80 and 90 may be rectangular in cross-sectional shape, as best shown in FIG. 3, may be circular in cross-sectional shape, as best shown in FIG. 4, or optionally, may be square in cross-sectional shape (not shown). Each conduit branch 80 and 90 has an internal passageway that extends the length thereof to allow for the passage of air, smoke and combustion gases therethrough. It should be understood that conventional ducts already existing within the residence 20 may be suitable to be adapted for use as conduits 67, 80 and 90. Alternatively, the conduits 67, 80 and 90 may be formed of other suitable duct material and installed at the time the system 10 is installed within the residence 20.

Returning to FIG. 1, the conduit branch 80 is provided with two smoke exhaust valves 125 and 130 located thereon. In particular, the smoke exhaust valve 125 is located on the conduit branch 80 approximately midway over the room 25 and the smoke exhaust valve 130 is located on the conduit branch 80 approximately midway over the room 30. Similarly, smoke exhaust valves 135 and 140 are located on the conduit branch 90 approximately midway over the rooms 35 and 40, respectively. Each of the smoke exhaust valves shown in the drawings are similar in construction and operate in the same manner.

At this juncture, it is important to point out that in accordance with this invention a greater or fewer number of smoke exhaust valves may be specified along the various conduit branches as may be required. Preferably, a conduit branch should have a number of smoke exhaust valves positioned thereon that equals the number of rooms through which the conduit branch extends. In other words, as shown in FIG. 1, conduit branch 80 extends above two rooms, i.e., rooms 25 and 30, and has two smoke exhaust valves, one being located over each room. Similarly, conduit branch 90 extends above two rooms, i.e., rooms 35 and 40, and has two smoke exhaust valves, one being located over each room. Alternatively, rooms that are rather large in size may warrant two or more smoke exhaust valves positioned thereover.

Figure 5:
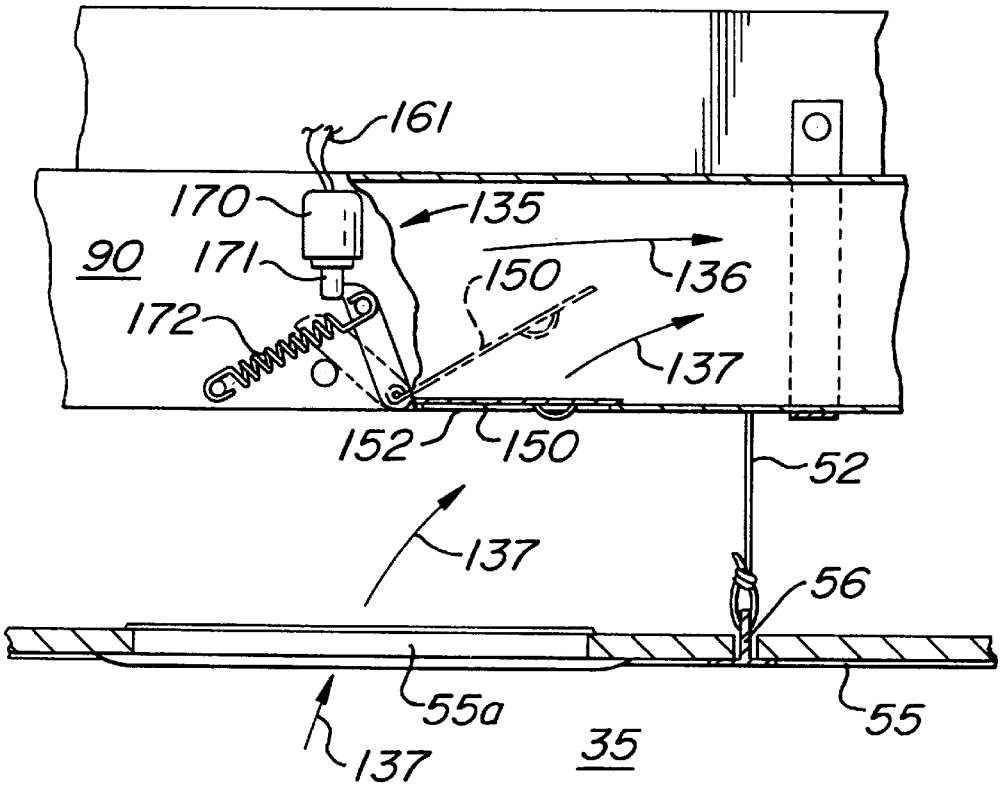
FIG. 5 is an enlargement of an area shown in FIG. 1 that is encircled by a line labelled FIG. 5 illustrating movement of vent door from the closed position, shown in solid lines, to the open position, shown in phantom lines.

The construction and operation of the smoke exhaust valve 135 will now be discussed. It should be understood that smoke exhaust valves 125, 130 and 140 are constructed and operate in a similar manner. Referring now to FIG. 5, there is shown therein the smoke exhaust valve 135 which comprises a vent door 150 that is hingedly mounted within the conduit branch 90. The vent door 150 is arranged swing between a normally covering position (shown in solid lines) wherein the vent door 150 covers an opening 152 located on the bottom wall of the conduit branch 90 to an open position (shown in phantom lines) that enables communication between the internal passageway of the conduit branch 90 and the room 35. The smoke exhaust valve 135 is provided with a solenoid operated latching means 170 which is in communication with the smoke detector 102 by suitable conductors 161. A spring means 172 resiliently biases the vent door 150 to the open position.

As shown in FIG. 5, the solenoid operated latching means 170 normally latches the vent door 150 in the normally covering position. Whenever the solenoid associated with the latching means 170 is energized by its energizing connection to the smoke detector 102, its associated latching yoke 171 is drawn upwardly thus enabling the vent door 150 to swing to the open position by operation of the spring means 172. It should be understood that the smoke exhaust valves 125, 130 and 140 are similarly constructed and energized by energizing connection to smoke detectors 106, 108 and 104, respectively, as shown in FIG. 1.

It should be understood that the smoke exhaust valve 135 described herein is merely exemplary and various alternative constructions of the valve could be utilized without departing from this invention. One such suitable alternative construction for the smoke exhaust valve which could be incorporated within any of the conduit branches described herein is shown at FIGS. 2 and 3 of U.S. Pat. No. 4,805,835 and described therein, the disclosure of which is hereby incorporated by reference. Also, as best shown in FIG. 5, the false ceiling 55 is provided with a ventilation tile 55*a* corresponding with and located directly below each smoke exhaust valve to facilitate withdrawal of smoke during operation of the system.

Referring now to FIG. 2, there is shown therein an extension segment 200 housed within the exit end of conduit branch 90. The extension segment 200 comprising an outwardly flared inlet end 210, an internal passageway 212 extending fully therethrough and an outlet end 220. The outlet end 220 is provided with a flange 222 and a door 224 hingedly attached thereto. The extension segment 200 may be formed of any suitable material resistant to heat, e.g., aluminum, steel or any hard plastic, such as polyvinyl chloride (PVC). Further, the extension segment 200 may be rectangular in cross-sectional shape, as best shown in FIG. 3, or, optionally, may be circular in cross-sectional shape, as best shown in FIG. 4 or square (not shown).

The extension segment 200 normally resides in a retracted position, shown in phantom lines, wherein the extension segment 200 is telescoped within the exit end of the conduit branch 90 and the flange 222 abuts flange 94 of the conduit branch 90 to prevent further movement of the extension segment 200 into the conduit branch 90 beyond the retracted position.

As best shown in FIG. 3, but also shown in FIG. 2, the extension segment 200 is provided with a plurality of rollers 230 that are affixed to the exterior surface of the extension segment 200 by any suitable means, e.g., brackets 232. Now referring to FIG. 2 only, likewise, rollers 231 are affixed to the interior surface of the conduit branch 90 just inside the exit end thereof. The number of rollers 230 and 231 shown in FIG. 2 is merely exemplary and a greater or fewer number could be specified in accordance with this invention. The rollers 230 and 231 enable rolling movement of the extension segment 200 along the interior surface of the conduit branch 90 from the retracted position, shown in phantom in FIG. 2, to the extended position, shown in solid lines therein. In the extended position, the outlet end 220 of the extension segment 200 actually extends beyond the pitched roof 22.

A shoulder 235 is provided along the inside surface of the conduit branch 90 and is arranged to obstruct further movement of the rollers 230 once the extension segment 200 reaches the extended position. Housed within the interior of the extension segment 200 is an electrically operated exhaust fan assembly 250 having a fan blade 251. It should be understood that the exhaust fan assembly 250 is an optional component of the system 10 and its absence will not render the system 10 inoperable.

The exhaust fan assembly 250 is in communication with the smoke detectors 102 and 104 by means of suitable conductors 252. Either of the smoke detectors 102 or 104 can provide an energizing current for the exhaust fan assembly 250. When activated, the exhaust fan assembly 250 causes the fan blade 251 to rotate and exhaust smoke and air from the internal passageway of the conduit 90 to the outside atmosphere.

Referring to FIG. 1, an extension segment 201, similar in construction and operation to that described at 200 is shown in the extended position at the exit end of conduit branch 80. An exhaust fan assembly, similar in construction and operation to that previously shown at 250 could be housed within the interior of the extension segment 201 and be in communication with smoke detectors 106 and 108. If the system 10 were to comprise a greater number of conduit branches, similar extension segments would be located at the exit ends of those additional conduit branches.

In view of the above, it can be seen by those having ordinary skill in the art that the method of operation of the system 10 of the present invention can be described as follows. Referring now to FIG. 1, smoke 260 resulting from a fire 262 that is burning in the room 35 rises in the known manner and reaches the smoke detector 102 affixed to decorative surface of the false ceiling 55. Upon detecting a predetermined concentration of smoke, the smoke detector 102 energizes the compressor unit 60 which forces air into the cylindrical vent duct 75. Referring now to FIG. 7, the smoke detector also provides an energizing current to the servo-motor 119 thus causing the vent door 118 to swing from the normal position (shown in solid lines) to an open position (shown in phantom lines) that enables the forced air to travel along branch 112 and into the various conduit branches 80 and 90 comprising the conduit network 65. Referring now to FIG. 5, the smoke detector 102 also energizes the solenoid operated latching means 170 associated with smoke exhaust valve 135 thus enabling the vent door 150 to swing from the normally covering position to the open position. Remaining smoke exhaust valves 125, 130 and 140 remain in the closed position, assuming smoke has not exceeded the predetermined level in rooms 25, 30 or 40.

As best shown in FIGS. 1 and 5, the action of the forced air (indicated by arrow labelled 136 in FIG. 5) passing over the vent door 150 creates a suction effect or an upward draft that draws the smoke 260 within the room 35 (indicated by arrows 137) upwardly through the ventilation tile 55*a* of the false ceiling 55, through opening 152 and into the internal passageway of the conduit branch 90. Referring now to FIG. 2, the forced air 136 through the internal passageway also acts to push against the flared inlet end 210 of the extension segment 200 thus causing the rollers 230 to roll and move the segment 200 from the retracted position, shown in phantom in FIG. 2, to the extended position, shown in solid lines therein. The shoulder 235 prevents further outward movement of the rollers 230 once the extension segment 200 reaches the extended position.

The smoke detector 102 also energizes the exhaust fan assembly 250 housed within the extension segment 200 which, in turn, rotates the fan blade 251. The rotating fan blade 251 creates sufficient air pressure to open door 224 thus enabling the venting of fumes to the outside atmosphere. Because the outlet end 220 of the extension segment 200 extends beyond the roof 22, exhausted fumes cannot reenter the building after being exhausted therefrom.

Once the fire has been extinguished, access to the extension segments 200 and 201 may be obtained by firemen or other personnel by climbing a ladder leaning against exterior wall 26. Each extension segment 200 may be return the its retracted position by manually pushing against the outlet end 220 thereof until the flange 222 comes into abutting relation with the flange 94.

Without further elaboration the foregoing will so fully illustrate my invention that others may, by applying current or future knowledge, adopt the same for use under various conditions of service.

I claim:

1. A system for exhausting smoke from a building, the building having a roof, exterior walls and at least one story, each story having a ceiling and a floor, the system comprising:

a. actuable compressor means arranged for drawing smokeless air from the atmosphere outside the building and forcing it through the inlet end of a main conduit in communication therewith said main conduit extending to each story of the building;

b. at least one branch conduit located on each story of the building, each said branch conduit having an inlet end, an outlet end, a length and at least one opening located along said length, said inlet end being connected to said main conduit, each said branch conduit permitting the passage of the forced air therethrough, said length extending across the story in proximity to the ceiling and projecting through an exterior wall of the building, said outlet end being open to the atmosphere outside;

c. an actuable smoke exhaust valve associated with each said opening, said smoke exhaust valve being moveable from a normally closed position that obstructs air flow through said opening to an open position that permits air and smoke to flow unobstructedly through said opening; and, d. smoke detection means for opening at least one smoke exhaust valve on a story where smoke has accumulated in response to detecting an amount of smoke that exceeds a predetermined level and for actuating said actuable compressor means whereupon said actuable compressor means forces air through said main conduit and at least a branch conduit on the story where smoke has accumulated thus creating positive air pressure therein which draws smoke from the story through each said unobstructed opening resulting in the smoke being vented to the atmosphere outside.

2. The system of claim 1 wherein said smoke detection means comprises a smoke detector.

3. The system of claim 1 wherein said actuable smoke exhaust valve comprises a vent door hingedly joined to said at least one branch conduit, said vent door arranged to swing from the closed position to the open position.

4. The system of claim 3 additionally comprising spring means resiliently biasing said vent door toward its open position and solenoid operated latching means for retaining said vent door in its normally closed position, said solenoid operated latching means being in communication with said smoke detection means and releasing said vent door upon receipt of an energizing current from said smoke detection means.

5. The system of claim 1 wherein said actuable compressor means is located outside the building and said main conduit projects from said actuable compressor means through an exterior wall of the building.

6. The system of claim 1 wherein said at least one branch conduit additionally comprises a cross-section that is generally rectangular in shape along the length thereof.

7. The system of claim 1 wherein said at least one branch conduit additionally comprises a cross-section that is generally square in shape along the length thereof.

8. The system of claim 1 wherein said at least one branch conduit additionally comprises a cross-section that is generally circular in shape along the length thereof.

9. The system of claim 1 additionally comprising an extension segment having an inlet end, an internal passageway extending fully therethrough and an outlet end, said extension segment normally being disposed in a retracted position within said at least one branch conduit proximate the outlet end thereof, said extension segment being moveable to extend outwardly from said retracted position to an extended position whereupon the outlet end of said extension segment extends for some distance beyond the roof of the building to prevent smoke exhausted to the atmosphere outside from reentering the building.

10. The system of claim 9 wherein said at least one branch conduit additionally comprises an inner surface and said extension segment additionally comprises an outer surface having a plurality of rollers mounted thereon and arranged to contact the inner surface of said at least one branch conduit to facilitate movement of the extension segment from said retracted position to said extended position.

11. The system of claim 10 additionally comprising a plurality of rollers mounted on said inner surface of said at least one branch conduit, said rollers being positioned thereon to contact the outer surface of said extension segment so as to facilitate movement of the extension segment from said retracted position to said extended position.

12. The system of claim 11 additionally comprising shoulder positioned on the inner surface of said at least one branch conduit, said shoulder being provided to prevent further outward extension of said extension segment once said segment reaches the extended position.

13. The system of claim 9 wherein said extension segment additionally comprises a cross-section that is generally circular in shape along the length thereof.

14. The system of claim 9 wherein said extension segment additionally comprises a cross-section that is generally rectangular in shape along the length thereof.

15. The system of claim 9 wherein the inlet end of said extension segment flares outwardly.

16. The system of claim 9 additionally comprising a smoke exhaust fan disposed within said extension segment and in communication with said smoke detection means, said smoke detection means activating said smoke exhaust fan on a story where smoke has accumulated in response to detecting an amount of smoke that exceeds said predetermined level.

17. The system of claim 9 additionally comprising an outlet door hingedly joined to the outlet end of said extension segment, said outlet door arranged to swing from a closed position where it normally obstructs the outlet end of said extension segment to an open position wherein said outlet end is unobstructed.

18. The system of claim 1 wherein a false ceiling is suspended from the ceiling of each story, the false ceiling having at least one ventilation tile thereon and wherein said at least one branch conduit extends between the ceiling and the false ceiling.

19. The system of claim 1 further including a plurality of rooms located on each story of the building and wherein said at least one branch conduit comprises a branch conduit that extends through the plurality of rooms on each story and wherein said at least one opening comprises a plurality of openings located on each said branch conduit and wherein said at least one actuable smoke exhaust valve comprises a plurality of actuable smoke exhaust valves located on each said branch conduit said plurality of smoke exhaust valves and openings located on each said branch conduit being equal in number to the plurality of rooms on each story of the building.

20. The system of claim 19 wherein said plurality of actuable smoke exhaust valves comprises one smoke exhaust valve located in each of the plurality of rooms through which each said branch conduit extends and wherein said plurality of openings comprises one opening located in each of the plurality of rooms through which each said branch conduit extends.

21. The system of claim 1 additionally comprising a flange disposed on the exit end of said at least one branch conduit for securing said at least one branch conduit to the exterior surface of an exterior wall of the building.

22. The system of claim 9 additionally comprising a flange disposed on the outlet end of said extension segment, said flange provided to prevent movement of the extension segment into said at least one branch conduit beyond the retracted position.

23. The system of claim 1 wherein said at least one branch conduit comprises a plurality of conduit branches.

24. The system of claim 1 wherein said at least one branch conduit extends above the ceiling of the room.

25. The system of claim 1 wherein said at least one branch conduit extends below the ceiling of the room.

* * * * *